United States Patent [19]

Focke

[11] 4,180,201

[45] Dec. 25, 1979

[54] PACK AND BLANK FOR MAKING THE PACK AND WEB OF PACKING MATERIAL FOR MAKING THE BLANKS

[75] Inventor: Heinz Focke, Verden, Fed. Rep. of Germany

[73] Assignee: Focke & Pfuhl, Verden, Fed. Rep. of Germany

[21] Appl. No.: 849,582

[22] Filed: Nov. 8, 1977

Related U.S. Application Data

[62] Division of Ser. No. 744,359, Nov. 23, 1976, Pat. No. 4,072,263.

[30] Foreign Application Priority Data

Jan. 12, 1976 [DE] Fed. Rep. of Germany ..... 2600822

[51] Int. Cl.[2] ..... B65D 5/72

[52] U.S. Cl. ..... 229/37 R; 229/DIG. 9

[58] Field of Search ..... 229/DIG. 9, 37

[56] References Cited

U.S. PATENT DOCUMENTS

| | | | |
|---|---|---|---|
| 344,367 | 6/1886 | Fiske | 229/DIG. 9 |
| 358,671 | 3/1887 | Jaeger | 229/DIG. 9 |
| 2,251,361 | 8/1941 | Lockwood | 229/DIG. 9 |
| 2,367,717 | 1/1945 | Davidson | 229/37 R |
| 2,429,540 | 10/1947 | Woodruff | 229/DIG. 9 |
| 2,581,237 | 1/1952 | Casler | 229/DIG. 9 |
| 3,003,674 | 10/1961 | Ringler | 229/DIG. 9 |
| 3,378,187 | 4/1968 | Sherrill et al. | 229/DIG. 9 |
| 3,985,287 | 10/1976 | Stetler | 229/37 R |
| 4,072,263 | 2/1978 | Focke | 229/37 R |

FOREIGN PATENT DOCUMENTS

| | | | |
|---|---|---|---|
| 937385 | 9/1963 | United Kingdom | 229/DIG. 9 |

*Primary Examiner*—Davis T. Moorhead

*Attorney, Agent, or Firm*—Sughrue, Rothwell, Mion, Zinn and Macpeak

[57] ABSTRACT

An oblong pack for holding contents conforming to the pack configuration consists of a folded blank defining opposed sidewalls and end walls with the end walls comprising end flaps folded against the contents end face. The pack is characterized by the end flaps being of unequal length, only a portion of the end flaps of opposite sidewalls covering one another in the folded condition, and the blank having a tooth engagement of the end flaps with adjacent blanks so it may be parted substantially free from waste from a web.

12 Claims, 6 Drawing Figures

PACK AND BLANK FOR MAKING THE PACK AND WEB OF PACKING MATERIAL FOR MAKING THE BLANKS

This is a division of application Ser. No. 744,359, filed Nov. 23, 1976, now U.S. Pat. No. 4,072,263, issued Feb. 7, 1978.

FIELD OF THE INVENTION

The invention relates to a pack formed from a blank with opposed sidewalls and end walls which comprise end flaps folded against the end face. The invention also relates to a blank for the making of a pack of the kind specified and a continuous web of packing material for the making of the blanks by parting from the web.

BACKGROUND OF THE INVENTION

More and more economy must be practiced in the use of material in designing packs and pack blanks. The invention relates to packs which are produced from blanks parted from a continuous web of packing material. More particularly, the invention relates to rectangular packs, namely so-called "jacketing packs" for housing a number of cigarette packs. Conventionally, cigarette packs are combined in groups and enveloped in a jacket blank. A blank of this kind consists of elongated, i.e., rectangular, blank with sidewalls having end flaps integrally adjoining the sidewalls at both ends. The end flaps are successively folded over into the plane of the end faces to form end walls.

It is an object of the invention to provide a pack, a blank suitable for the making of the pack, and a web of packing material which are so designed that the blanks can be produced with the minimum of material and waste by parting the blanks from the web or from some other large-area sheet of packing material.

SUMMARY OF THE INVENTION

To this end, the pack and the blank according to the invention are characterized by the following features:

(a) The end flaps are of unequal length;

(b) Only a portion of the end flaps of opposite sidewalls cover one another in the folded condition; and (c) The blank can be parted substantially free from waste from a web or the like by a toothed engagement of the end flaps with adjacent blanks.

The elongated web is characterized by succeeding, alternate end and sidewall zones.

In the zone of the end walls, the blank for a pack of the kind specified is therefore so constructed that the end flaps of the opposite sidewalls (with the exception of an outer cover flap) do not extend over the full length and width of the pack end face. Only a portion of the folded end flaps therefore cover one another in the zone of a narrow strip. However, the outer cover flap extends over the full pack end face.

The blank is so constructed that a substantially rectangular portion is formed by the four sidewalls of the blank, which sidewalls are integrally edge linked to each other transversely of the web of packing material. This portion is adjoined on both sides by end flaps of unequal lengths, which have a toothed engagement with the end flaps of adjacent blanks. The relative arrangement is such that the individual blanks can be parted from the continuous web by a suitably designed parting blade.

Further features of the invention relate to the construction of the pack, blanks and web of packing material.

Embodiments of the invention will now be described in greater detail with reference to the drawings.

DESCRIPTION OF THE PREFERRED EMBODIMENTS

Figure 1:
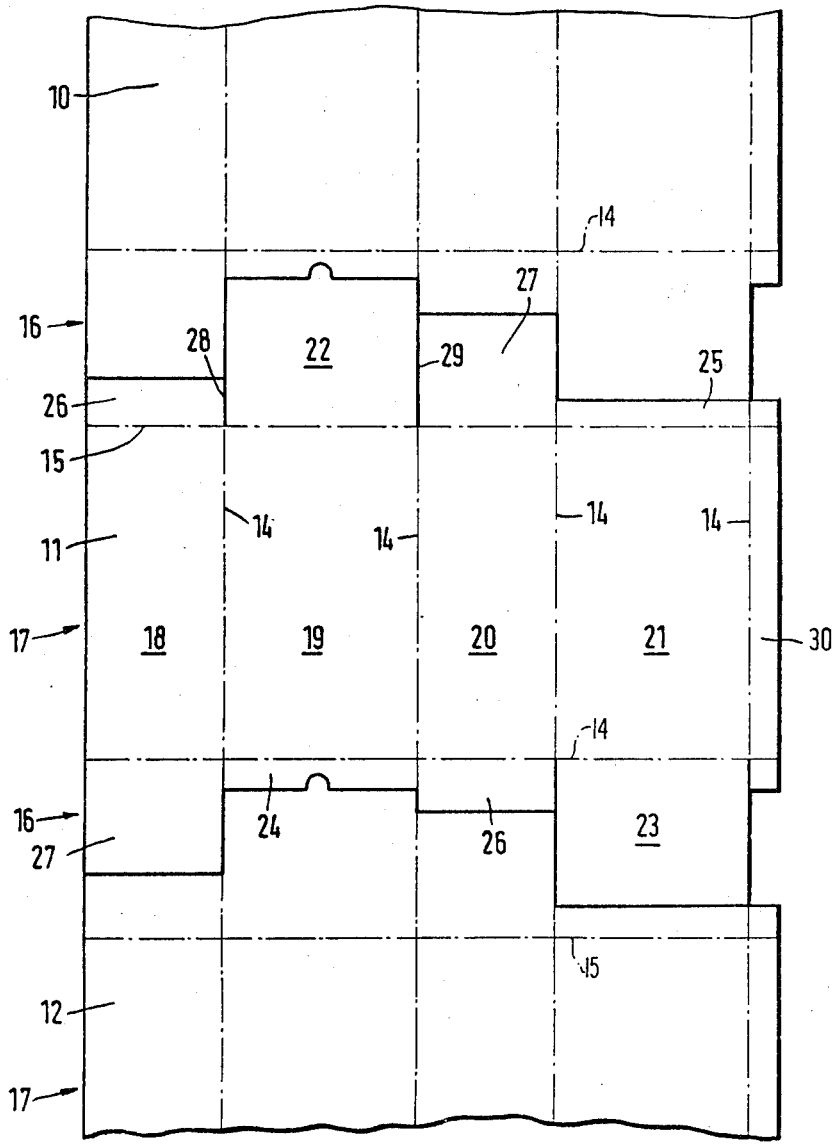
FIG. 1 is a plan view of a portion of the web of packing material with marked blanks.

FIG. 1 shows a portion of a continuous web of packing material drawn off, for instance, from a bobbin (not shown). Individual blanks 10, 11, 12 are parted successively from the web. From the blanks, packs are made, in this instance jacketed packs containing a number of individual cigarette packs or the like.

Each blank 10, 11 is subdivided into individual areas which are marked, for instance, by pre-embossed longitudinally and transversely extending folding lines 14, 15. The result is rectangular portions or zones 16, 17 of different length which succeed one another in the direction of the web and are each limited by the transversely directed folding lines 15. Zone 16 comprises, for the web, the end flap zone common to adjacent blanks. Zone 17 comprises a web zone for the sidewalls of a given blank.

The portions 17 form areas which take the form of the sidewalls 18–21 in the finished pack. The sidewalls 18–21 can have different widths in pairs, so that the pack is of non-square, rectangular cross-section.

Those ends of the sidewalls 18–21 which point in the longitudinal direction of the web are integrally adjoined to end flaps whose width corresponds to that of the sidewalls. The end flaps of unequal length are therefore the extensions of the sidewalls 18–21.

Figure 2:
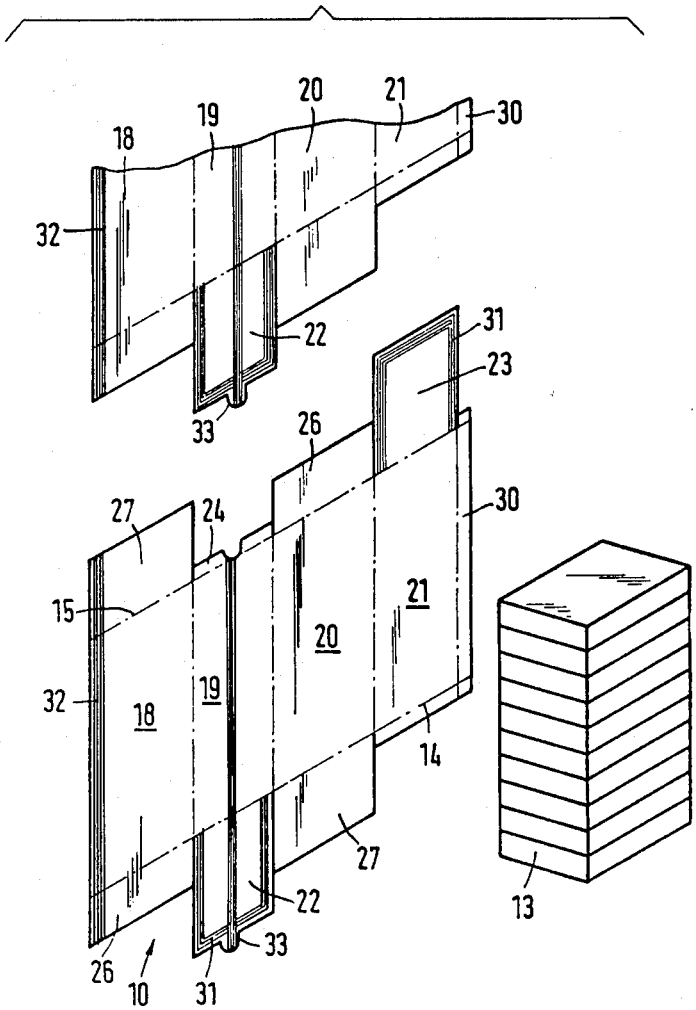
FIG. 2 is a perspective view of a blank according to the invention, parted from a web, and in a position for receiving the contents of the pack.
Figures 3A, 3B, 3C:
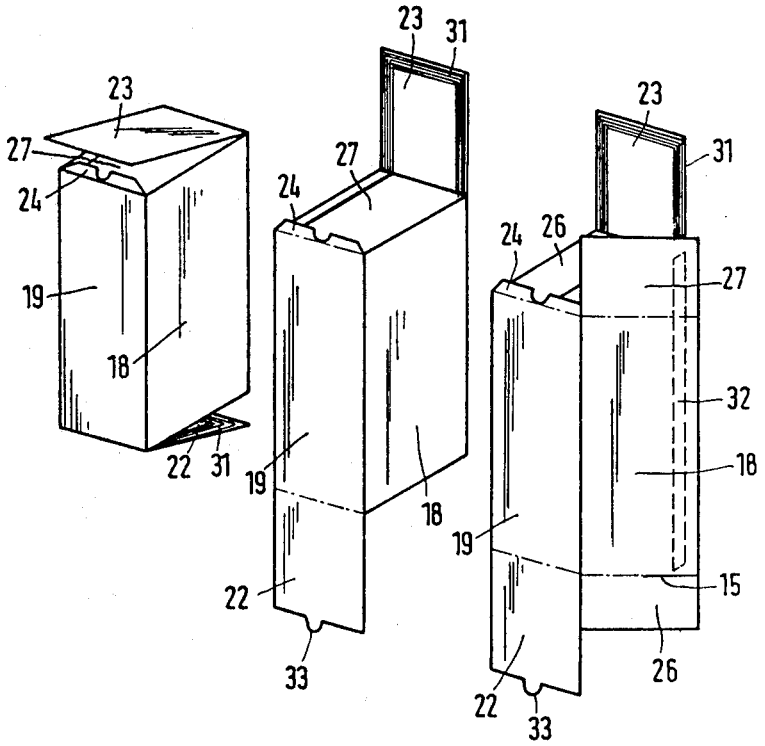
FIGS. 3*a*, 3*b* and 3*c* are sequential perspective views of folding positions of the blank during the making of the pack.

In the embodiment illustrated in FIGS. 1–3, cover flaps 22, 23 are integral extensions of the sidewalls 19, 20 and which extend opposite to one another in the pack. The cover flaps 22, 23 are of such dimensions that in the finished pack they cover the outside of the pack end faces over substantially the full end face area (FIG. 3). Relatively narrow connecting strips 24, 25 adjoin those ends of the sidewalls 19, 21 which are opposite the cover flaps 22, 23.

Taken together, the cover flaps 22, 23 and the connecting strips 24, 25 extend the full length of the end flap zones or portions 16 in the longitudinal direction of the web.

Inner flaps 26, 27 of different lengths adjoin respective sidewalls 18, 20. The inner flaps 26, 27 are also of such dimensions that a short inner flap 26 together with a long inner flap 27 occupy the complete length of the end flap portions 16.

The end flaps 22–27 are offset within the blanks 10–12 in a manner such that a toothed engagement is formed in relation to the end flaps 22–27 of the adjoining blanks.

As a result, the blanks 10–12 are parted from the web without waste.

This arrangement of the end flaps of identical size on different sides of the blank, but on opposite sidewalls 18–21, ensures a repeated cutting line between the successive blanks 10–12. As a result, each of the parting cuts can be carried out by a joint, rhythmically moved parting blade which is so constructed that during the parting cut for the individual blanks 10–12, simultaneously the cover flaps 22, 23 are parted by corresponding parting cuts 28, 29 on the adjoining inner flaps 26, 27. The inner flaps 26, 27 are connected to the remaining adjacent end flaps, so that sealing tight corners are formed by corresponding folding of the end faces.

In the present case, an edge strip 30 adjoins the outside sidewall 21. During the formation of the pack, the edge strip 30 extending along the edge of sidewall 21 is connected to the free edge of the sidewall 18.

The blank with the aforementioned features, which is parted from the web conventionally fed in a vertical plane, is laid or folded in such vertical position around a stack of individual packs 13. The stack of individual packs 13 derives directly from the packing machine without any change in relative position. The stack of individual packs 13 is moved against the sidewall 20 of the blank 10, FIG. 2. At the same time, the other sidewalls 18, 19; 21 are folded into U-shape around the individual packs 13. They are so laid in further folding steps around the individual packs 13 that a tube-shaped enveloping of the stack of individual packs 13 is formed, accompanied by the connection of the edge strip 30 to the sidewall 18 with edges of sidewalls 18 and 21 abutting.

At the same time, the end flaps, which at first project beyond the stack of individual packs 13, are folded, the inner flaps 26, 27 being first folded against the contents of the pack. First of all, the large area inner flap 27 is folded under, so that the contents of the pack obtain a relatively large bearing surface on the underside. Then the inner flap 26 is folded over flap 27, in each case. The next thing is that the narrow connecting strips 24; 25 are folded over. Lastly, the cover flaps 22, 23 are folded over from opposite sides into the plane of respective end faces of the packs.

In this case, the individual blank parts are interconnected by adhesive strips 31, 32 which can be formed, for instance, by the hot melt method. An adhesive strip 32 extends along the edge over the whole length of the sidewall 18, including the adjoining inner flaps 26, 27. A U-shaped adhesive strip 31 is provided at the free edges of the cover flaps 22, 23 in the end flap zone thereof. In addition, in the embodiment illustrated in FIG. 2, the sidewall 19 along with the adjoining cover flap 22 is formed with a tear-open strip 33.

Figure 4:
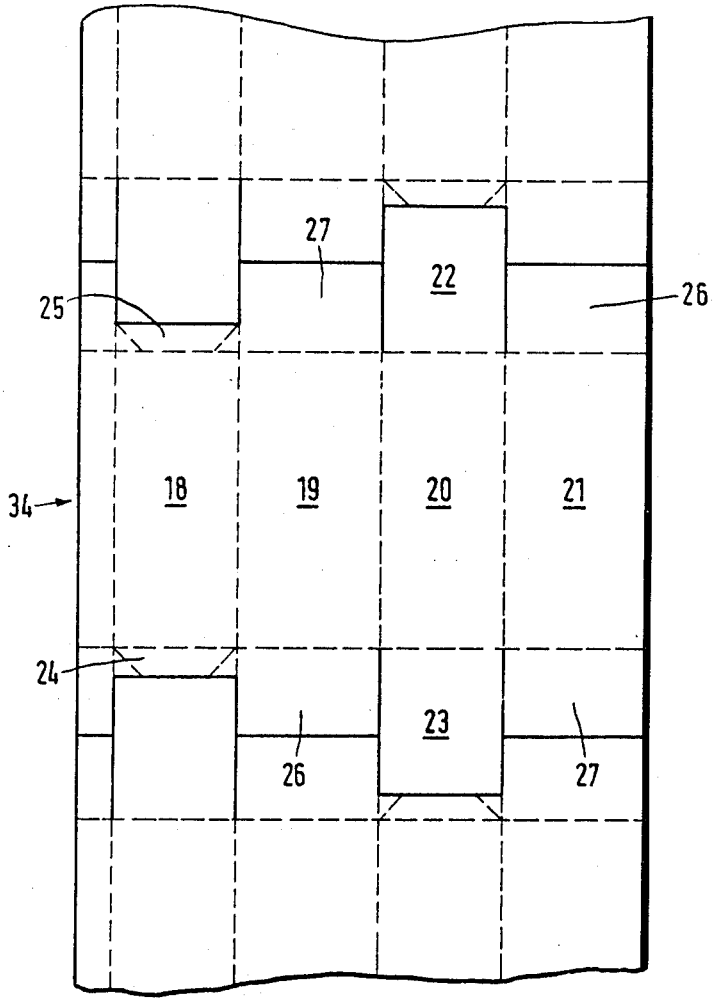
FIG. 4 is a plan view of a portion of a web of packing material, corresponding to FIG. 1, with a variant embodiment of the blank.

The blank 34 illustrated in FIG. 4 differs from the preceding embodiment in that identical end flaps are formed at opposite ends of the same sidewalls. This means that both cover flaps 22, 23 are integral extensions of the sidewall 20, while the opposite sidewall 18 carries the two connecting strips 24, 25. In this case, the inner flaps 26, 27 have the same length. With the blank 34, operations must be performed using two differently constructed parting blades which perform a parting cut alternately. Alternatively, operations can be performed employing one joint parting blade which, after each parting cut, makes a lateral offsetting movement to move to the necessary position in relation to the web.

The given width of the portion 16 ensures that on the one hand the opposite end flaps, namely the cover flaps 22, 23, and on the other hand the connecting strips 24, 25, and also on the one hand the inner flaps 26, and on the other hand the inner flaps 27 cover one another in folded condition in a zone corresponding to the length of the connecting strips 24, 25.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A block shaped package formed from a blank having four laterally edge joined sidewalls defining two opposed pair of sidewalls, said blank also having opposed end walls, said end walls being made up by terminal flaps integral with and extending from respective sidewalls, said terminal flaps being of of unequal length and being folded into the plane of the end walls, said package blank thereby having two inside sidewalls and outside sidewalls on opposite sides thereof, one terminal flap situated on the outside, covering up the entire end of said pack, the improvement wherein:

both end walls of the package are developed essentially equal, all terminal flaps are of rectangular shape, and the terminal flaps of both end walls are attached to the sidewalls at respective ends thereof and are dimensioned in such a way, that as a result of the dovetailed position of the terminal flaps of one blank with the terminal flaps of two adjacent blanks, the latter are cut without waste from one web of the packaging material, and the terminal flaps constituting cover flaps of one blank and correspondingly the connecting strips corresponding thereto are disposed at opposite sidewalls.

2. The package as claimed in claim 1, wherein the blanks are interconnected by adhesive strips including a continuous adhesive strip formed at the free edge of a sidewall inclusive of the inside flaps succeeding them, and a U-shaped adhesive strip formed in the area of the two cover flaps along their free edges.

3. The package as claimed in claim 1, wherein one sidewall inclusive of the cover flap succeeding said wall, as well as of the opposite connecting strip, are provided with a continuous tear-open strip extending in a longitudinal direction.

4. The package as claimed in claim 2, wherein one sidewall inclusive of the cover flap succeeding said wall, as well as of the opposite connecting strip, are provided with a continuous tear-open strip extending in a longitudinal direction.

5. The package as claimed in claim 1, wherein the inside terminal flaps are of unequal size, and the largest of said terminal flaps is folded first, in the area of one end wall pointing downward during the production of the package, into the plane of the end wall.

6. The package as claimed in claim 2, wherein the inside terminal flaps are of unequal size, and the largest of said terminal flaps is folded first, in the area of one end wall pointing downward during the production of the package, into the plane of the end wall.

7. The package as claimed in claim 3, wherein the inside terminal flaps are of unequal size, and the largest of said terminal flaps is folded first, in the area of one end wall pointing downward during the production of the package, into the plane of the end wall.

8. The package as claimed in claim 4, wherein the inside terminal flaps are of unequal size, and the largest of said terminal flaps is folded first, in the area of one end wall pointing downward during the production of the package, into the plane of the end wall.

9. The package as claimed in claim 5, wherein the larger inside flap of the end wall, pointed downward during production of the package is disposed at a sidewall situated at the inside area of the blank.

10. The package as claimed in claim 6, wherein the larger inside flap of the end wall, pointed downward during production of the package is disposed at a sidewall situated at the inside area of the blank.

11. The package as claimed in claim 7, wherein the larger inside flap of the end wall, pointed downward during production of the package is disposed at a sidewall situated at the inside area of the blank.

12. The package as claimed in claim 8, wherein the larger inside flap of the end wall, pointed downward during production of the package is disposed at a sidewall situated at the inside area of the blank.

* * * * *